US009987842B2

(12) United States Patent
Luo et al.

(10) Patent No.: US 9,987,842 B2
(45) Date of Patent: Jun. 5, 2018

(54) PRINTHEAD WITH A NUMBER OF MEMRISTORS AND INVERTERS

(71) Applicant: HEWLETT-PACKARD DEVELOPMENT COMPANY, L.P., Houston, TX (US)

(72) Inventors: Jianwen Luo, Singapore (SG); Leong Yap Chia, Singapore (SG); Ning Ge, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/518,934

(22) PCT Filed: Oct. 29, 2014

(86) PCT No.: PCT/US2014/062925

§ 371 (c)(1),
(2) Date: Apr. 13, 2017

(87) PCT Pub. No.: WO2016/068912

PCT Pub. Date: May 6, 2016

(65) Prior Publication Data

US 2017/0239941 A1 Aug. 24, 2017

(51) Int. Cl.
*B41J 2/045* (2006.01)
*B41J 2/175* (2006.01)

(52) U.S. Cl.
CPC ..... *B41J 2/04541* (2013.01); *B41J 2/0458* (2013.01); *B41J 2/04581* (2013.01); *B41J 2/1753* (2013.01)

(58) Field of Classification Search
None
See application file for complete search history.

(56) References Cited

U.S. PATENT DOCUMENTS

| | | | |
|---|---|---|---|
| 7,518,903 | B2 | 4/2009 | Shirahama et al. |
| 7,679,954 | B2 | 3/2010 | Lee et al. |
| 8,385,100 | B2 | 2/2013 | Kau et al. |
| 2011/0228600 | A1 | 9/2011 | Breitwisch et al. |
| 2012/0013306 | A1 | 1/2012 | Kadirvel et al. |

(Continued)

FOREIGN PATENT DOCUMENTS

| | | | | |
|---|---|---|---|---|
| WO | WO-2013057585 | A2 | 4/2013 | |
| WO | WO 2015167477 | A1 * | 11/2015 | ..... B41J 2/17546 |

OTHER PUBLICATIONS

IP.com search.*

(Continued)

*Primary Examiner* — Lisa M Solomon
(74) *Attorney, Agent, or Firm* — Fabian VanCott

(57) ABSTRACT

A print head with a number of memristors and inverters is described. The print head includes a number of nozzles to deposit an amount of fluid onto a print medium. Each nozzle includes a firing chamber to hold the amount of fluid, an opening to dispense the amount of fluid onto the print medium, and an ejector to eject the amount of fluid through the opening. The print head also includes a number of memristor cells. Each memristor cell includes a memristor to store data, a voltage divider serially connected to the 116 memristor cell, and an inverter connected in parallel with the number of memristor cells and the voltage divider.

15 Claims, 9 Drawing Sheets

(56) References Cited

U.S. PATENT DOCUMENTS

| | | | |
|---|---|---|---|
| 2013/0106930 | A1 | 5/2013 | Lea et al. |
| 2013/0175497 | A1 | 7/2013 | Yang et al. |
| 2013/0235648 | A1 | 9/2013 | Kim et al. |
| 2013/0278656 | A1 | 10/2013 | Govyadinov et al. |
| 2014/0252304 | A1 | 9/2014 | Soeya et al. |

OTHER PUBLICATIONS

Homouz, D. et al., Memristor: Modeling Read and Write Operations [online] IEEE, Dec. 19-22, 2011, Retrieved from the Internet <http://ieeexplore.ieee.org/stamp/stamp.jsp?

* cited by examiner

PRINTHEAD WITH A NUMBER OF MEMRISTORS AND INVERTERS

BACKGROUND

A memory system may be used to store data. In some examples, imaging devices, such as printheads may include memory to store information relating to printer cartridge identification, security information, and authentication information, among other types of information.

BRIEF DESCRIPTION OF THE DRAWINGS

The accompanying drawings illustrate various examples of the principles described herein and are a part of the specification. The illustrated examples do not limit the scope of the claims.

Throughout the drawings, identical reference numbers designate similar, but not necessarily identical, elements.

DETAILED DESCRIPTION

Figure 1:
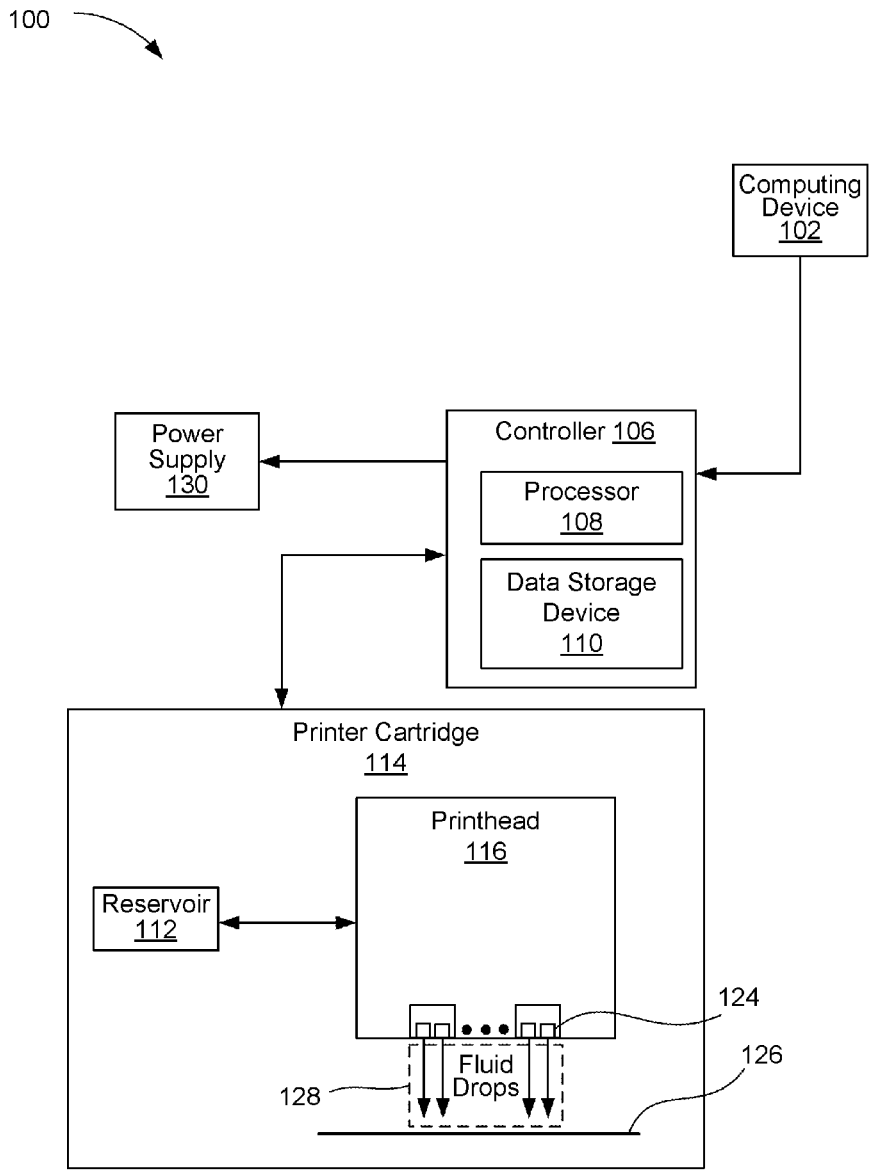
FIG. 1 is a diagram of a printing system according to one example of the principles described herein.

Memory devices are used to store information for a printer cartridge. Printer cartridges include memory to store information related to the operation of the printhead. For example, a printhead may include memory to store information related 1) to the printhead; 2) to fluid, such as ink, used by the printhead; or 3) to the use and maintenance of the printhead. Other examples of information that may be stored on a printhead include information relating to 1) a fluid supply, 2) fluid identification information, 3) fluid characterization information, and 4) fluid usage data, among other types of fluid or imaging device related data. More examples of information that may be stored include identification information, serial numbers, security information, feature information, Anti-Counterfeiting (ACF) information, among other types of information. While memory usage on printheads is desirable, changing circumstances may reduce their efficacy in storing information.

For example, an increasing trend in counterfeiting may lead to current memory devices being too small to contain sufficient anti-counterfeiting information and security and authentication information. Additionally, with loyalty customer reward programs, new business models and other customer relation management programs through cloud-printing and other printing architectures, additional market data, customer appreciation value information, encryption information, and other types of information on the rise, a manufacturer may desire to store more information on a memory device.

Moreover, as new technologies develop, circuit space is becoming more valuable. Accordingly, it may be desirable for the greater amounts of data storage to occupy less space within a device. Memristors may be used due to their non-volatility, low operational power consumption characteristics, and their compact size. A memristor selectively stores data based on a resistance state of the memristor. For example, a memristor may be in a low resistance state indicated by a "1," or a high resistance state indicated by a "0." Memristors may form a string of ones and zeroes that will store the aforementioned data. If an analog memristor is used, there may be many different resistance states.

A memristor may switch between a low resistance state and a high resistance state during a switching event in which a voltage is applied to the memristor. Each memristor has a switching voltage that refers to a voltage used to switch the state of the memristors. When the supplied voltage is greater than the memristor switching voltage, the memristor switches state. While memristors may be beneficial as memory storage devices, their use presents a number of complications.

For example, backward compatibility of devices utilizing memristors as non-volatile memory may encounter difficulties. More specifically, many devices currently utilize one type of erasable programmable read-only memory (EPROM) which is in a low resistance state prior to programming and after programming is put in a high resistance state.

However, a memristor is naturally opposite to this type of EPROM memory device. More specifically, when in the virgin state before programming, the memristor is in a high resistance state, and after programming the memristor is in a low resistance state. This may create backwards compatibility issues with existing devices. Such backwards compatibility may be beneficial in that it allows memristor memory to be used in existing components that previously used other memory elements such as initially low resistance state EPROM memory.

Accordingly, the present specification describes a printhead and printer cartridge having a number of memristor cells and an inverter. In this example, the inverter may be a circuit element placed in parallel with a memristor cell in order to output a resistance state that is the inverse of the actual resistance of the memristor. A voltage divider placed in series with the memristor cell is used to control the voltage across the memristor during read and write operations. The inverter circuit includes a transistor and a low value resistor. The voltage divider may be a high value resistor. When the resistance state of the memristor is high, i.e., in a virgin state, the voltage between the memristor and the voltage divider is above the threshold voltage of the inverting transistor. This turns on the inverting transistor, and the resulting circuit has two parallel branches, one including the memristor cell and one including the inverting circuit. Based on the equation for parallel resistors $$\left(\frac{1}{R_{total}} = \frac{1}{R_1} + \frac{1}{R_2} + \dots\right),$$

the overall resistance of the circuit is going to be low. This circuit effectively inverts the resistance state of the memristor, which is in a high resistance state, yet the resistance of the entire system is seen from the outside as low.

The inverter also outputs a resistance state that is the inverse of the actual resistance of the memristor. For example, when the memristor is in the low resistance state, the voltage found between the voltage divider and the memristor will be below the threshold voltage of the inverting transistor, leaving it in an off state. The effective circuit is of two resistors (i.e., the resistor and the memristor) in series, and after adding the resistance of the voltage divider resistor and the memristor, the overall resistance is high. This circuit effectively inverts the resistance as measured from outside the system. The resistance state of the memristor is low, yet the resistance of the entire system is high.

The present disclosure describes a printhead with a number of memristors and a number of inverters. The printhead includes a number of nozzles to deposit an amount of fluid onto a print medium. Each nozzle includes a firing chamber to hold the amount of fluid, an opening to dispense the amount of fluid onto a print medium, and an ejector to eject the amount of fluid through the opening. The printhead also includes a number of memristor cells to store data. The printhead also includes at least one voltage divider serially connected to the memristor cell. The printhead also includes at least one inverter connected in parallel with a memristor cell and the voltage divider.

The present disclosure describes a printer cartridge with a number of memristors and inverters. The cartridge includes a fluid supply and a printhead to deposit fluid from the fluid supply onto a print medium. The printhead includes a number of memristor cells, each cell including a memristor to store data; a number of voltage dividers serially connected to the memristor cells; and at least one inverter connected in parallel with the number of memristor cells.

A printer cartridge and a printhead that utilize memristor cells and inverters, such as inverter circuits, may be beneficial by outputting a resistance that is inverse of the resistance state of the memristor cells so as to avoid backward compatibility issues which may occur with the use of memristors as non-volatile memory in a printhead or printer cartridge. Additionally, the printer cartridge and printhead of the present specification solve the issue of the memristor virgin resistance state being opposite to other memory devices.

As used in the present specification and in the appended claims, the term "printer cartridge" may refer to a device used in the ejection of ink, or other fluid, onto a print medium. In general, a printer cartridge may be a fluidic ejection device that dispenses fluid such as ink, wax, polymers or other fluids. A printer cartridge may include a printhead. In some examples, a printhead may be used in printers, graphic plotters, copiers and facsimile machines. In these examples, a printhead may eject ink, or another fluid, onto a medium such as paper to form a desired image or a desired three-dimensional geometry.

Accordingly, as used in the present specification and in the appended claims, the term "printer" is meant to be understood broadly as any device capable of selectively placing a fluid onto a print medium. In one example the printer is an inkjet printer. In another example, the printer is a three-dimensional printer. In yet another example, the printer is a digital titration device.

Still further, as used in the present specification and in the appended claims, the term "fluid" is meant to be understood broadly as any substance that continually deforms under an applied shear stress. In one example, a fluid may be a pharmaceutical. In another example, the fluid may be an ink. In another example, the fluid may be a liquid.

Still further, as used in the present specification and in the appended claims, the term "print medium" is meant to be understood broadly as any surface onto which a fluid ejected from a nozzle of a printer cartridge may be deposited. In one example, the print medium may be paper. In another example, the print medium may be an edible substrate. In yet one more example, the print medium may be a medicinal pill.

Even yet further, as used in the present specification and in the appended claims, the term "memristor" may refer to a passive two-terminal circuit element that maintains a functional relationship between the time integral of current, and the time integral of voltage.

Yet further, as used in the present specification and in the appended claims, the term "inverter" may refer to a circuit element which outputs the opposite of what is input. For example, if a low resistance is read at the input, a high resistance will be read at the output.

Yet further, as used in the present specification and in the appended claims, the term "a number of" or similar language may include any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Turning now to the figures, FIG. 1 is a diagram of a printing system (100) according to one example of the principles described herein. In some examples, the printing system (100) may be included on a printer. The system (100) includes an interface with a computing device (102). The interface enables the system (100), and specifically the processor (108), to interface with various hardware elements, such as the computing device (102), external and internal to the system (100). Other examples of external devices include external storage devices, network devices such as servers, switches, routers, and client devices among other types of external devices.

In general, the computing device (102) may be any source from which the system (100) may receive data describing a print job to be executed by the controller (106) in order to eject fluid onto the print medium (126). For example, via the interface, the controller (106) receives data from the computing device (102) and temporarily stores the data in the data storage device (110). Data may be sent to the controller (106) along an electronic, infrared, optical, or other information transfer path. The data may represent a document and/or file to be printed. As such, data forms a job and includes job commands and/or command parameters.

A controller (106) includes a processor (108), a data storage device (110), firmware, software, and other electronics for communicating with and controlling the printhead (116). The controller (106) receives data from the computing device (102) and temporarily stores data in the data storage device (110).

The controller (106) controls the printhead (116) in ejecting fluid from the nozzles (124). For example, the controller (106) defines a pattern of ejected fluid drops that form characters, symbols, and/or other graphics or images on the print medium (126). The pattern of ejected fluid drops is determined by the print job commands and/or command parameters received from the computing device (102). The controller (106) may be an application specific integrated circuit (ASIC), on a printer for example, which determines the level of fluid in the printhead (116) based on resistance values of memristors integrated on the printhead (116). The ASIC may include a current source and an analog to digital converter (ADC). The ASIC converts a voltage present at the current source to determine a resistance of a memristor, and then determine a corresponding digital resistance value through the ADC. Computer readable program code, executed through executable instructions enables the resistance determination and the subsequent digital conversion through the ADC. By ensuring backward compatibility the ASIC of previous devices will not need significant modification to use memristor memory devices on the printhead (116).

The processor (108) may include the hardware architecture to retrieve executable code from the data storage device (110) and execute the executable code. The executable code may, when executed by the processor (108), cause the processor (108) to implement at least the functionality of ejecting fluid onto the print medium (126). The executable code may, when executed by the processor (108), cause the processor (108) to implement the functionality of providing instructions to the power supply (130) such that the power supply (130) provides power to the components of the system (100).

The data storage device (110) may store data such as executable program code that is executed by the processor (108) or other processing device. The data storage device (110) may specifically store computer code representing a number of applications that the processor (108) executes to implement at least the functionality described herein.

Generally, the data storage device (110) may include a computer readable medium, a computer readable storage medium, or a non-transitory computer readable medium, among others. For example, the data storage device (110) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The printing system (100) includes a printer cartridge (114) that includes a printhead (116) and a reservoir (112). The printer cartridge (114) may be removable from the printer (104) for example, as a replaceable printer cartridge (114).

The printer cartridge (114) includes a printhead (116) that ejects drops of fluid through a plurality of nozzles (124) towards a print medium (126). The print medium (126) may be any type of suitable sheet or roll material, such as paper, card stock, transparencies, polyester, plywood, foam board, fabric, canvas, and the like. In another example, the print medium (126) may be an edible substrate. In yet one more example, the print medium (126) may be a medicinal pill. As will be described below, the printhead (116) may include a number of memristors to store information and a number of inverters to present an inverted resistance value to the controller (106).

Nozzles (124) may be arranged in a number of columns or arrays such that properly sequenced ejection of fluid from the nozzles (124) causes characters, symbols, and/or other graphics or images to be printed on the print medium (126) as the printhead (116) and print medium (126) are moved relative to each other. In one example, the number of nozzles (124) fired may be a number less than the total number of nozzles (124) available and defined on the printhead (116).

The printer cartridge (114) also includes a fluid reservoir (112) to supply an amount of fluid to the printhead (116). In general, fluid flows between the reservoir (112) to the printhead (116). In some examples, a portion of the fluid supplied to printhead (116) is consumed during operation and fluid not consumed during printing is returned to the reservoir (112).

In some examples, a mounting assembly positions the printhead (116) relative to a media transport assembly, and media transport assembly positioning the print medium (126) relative to printhead (116). Thus, a print zone (128), indicated by the dashed box, is defined adjacent to the nozzles (124) in an area between the printhead (116) and the print medium (126). In one example, the printhead (116) is a scanning type printhead (116). As such, the mounting assembly includes a carriage for moving the printhead (116) relative to the media transport assembly to scan the print medium (126). In another example, the printhead (116) is a non-scanning type printhead (116). As such, the mounting assembly fixes the printhead (116) at a prescribed position relative to the media transport assembly. Thus, the media transport assembly positions the print medium (126) relative to the printhead (116).

Figure 2A:
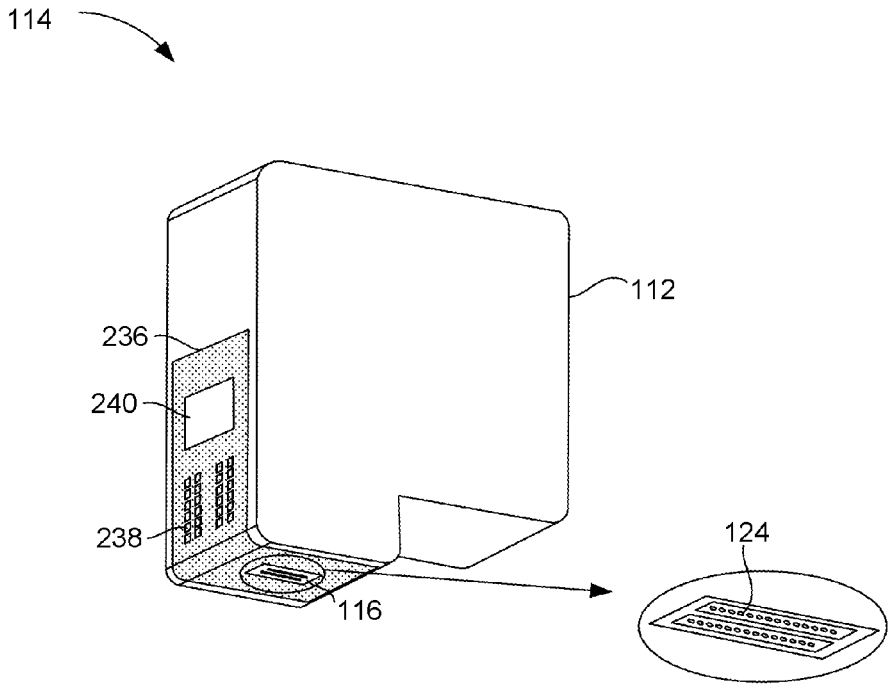
FIG. 2A is a diagram of a printer cartridge with a number of memristors and inverters according to one example of the principles described herein.
Figure 2B:
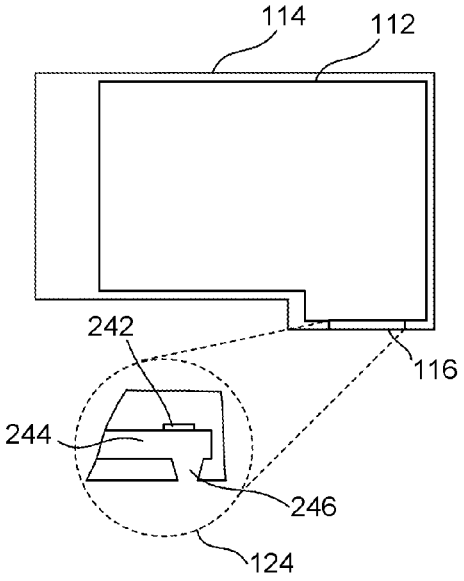
FIG. 2B is a cross sectional diagram of a printer cartridge with a number of memristors and inverters according to one example of the principles described herein.

FIG. 2A is a diagram of a printer cartridge (114) and printhead (116) with a number of memristors and inverters according to one example of the principles described herein. As discussed above, the printhead (116) may include a number of nozzles (124). In some examples, the printhead (116) may be broken up into a number of print dies with each die having a number of nozzles (124). The printhead (116) may be any type of printhead (116) including, for example, a printhead (116) as described in FIGS. 2A and 2B. The examples shown in FIGS. 2A and 2B are not meant to limit the present description. Instead, various types of printheads (116) may be used in conjunction with the principles described herein.

The printer cartridge (114) also includes a fluid reservoir (112), a flexible cable (236), conductive pads (238), and a memristor array (240). The flexible cable (236) is adhered to two sides of the printer cartridge (114) and contains traces that electrically connect the memristor array (240) and printhead (116) with the conductive pads (238).

The printer cartridge (114) may be installed into a cradle. When the printer cartridge (114) is correctly installed into a device, such as a printer, the conductive pads (238) are pressed against corresponding electrical contacts in the cradle, allowing the device to communicate with, and control the electrical functions of, the printer cartridge (114). For example, the conductive pads (238) allow the device to access and write to the memristor array (240).

The memristor array (240) may contain a variety of information including the type of printer cartridge (114), the kind of fluid contained in the printer cartridge (114), an estimate of the amount of fluid remaining in the fluid reservoir (112), calibration data, error information, and other data. In one example, the memristor array (240) may include information regarding when the printer cartridge (114) should be maintained. The memristor array (240) may include other information as described below in connection with FIG. 3. The memristor array (240) may include a number of memristor cells to store information and inverters to output an inverted resistance for a memristor cell.

To eject fluid, the system (FIG. 1, 100) moves the carriage containing the printer cartridge (114) relative to a print medium (FIG. 1, 126). At appropriate times, the system (FIG. 1, 100) sends electrical signals to the printer cartridge (114) via the electrical contacts in the cradle. The electrical signals pass through the conductive pads (238) and are routed through the flexible cable (236) to the printhead (116). The printhead (116) then ejects a small droplet of fluid from the reservoir (112) onto the surface of the print medium (FIG. 1, 126).

The printhead (116) may include any number of nozzles (124). In an example where the fluid is an ink, a first subset of nozzles (124) may eject a first color of ink while a second subset of nozzles (124) may eject a second color of ink. Additional groups of nozzles (124) may be reserved for additional colors of ink.

FIG. 2B is a cross sectional diagram of a printer cartridge (114) and printhead (116) with a number of memristors and inverters according to one example of the principles described herein. The printer cartridge (114) may include a fluid supply (112) that supplies the fluid to the printhead (116) for deposition onto a print medium (FIG. 1, 126). In some examples, the fluid may be ink. For example, the printer cartridge (114) may be an inkjet printer cartridge, the printhead (116) may be an inkjet printhead, and the ink may be inkjet ink.

The printer cartridge (114) may include a printhead (116) to carry out at least a part of the functionality of depositing fluid onto a print medium (FIG. 1, 126). The printhead (116) may include a number of components for depositing a fluid onto a print medium (FIG. 1, 126). For example, the printhead (116) may include a number of nozzles (124). For simplicity, FIG. 2B indicates a single nozzle (124), however a number of nozzles (124) are present on the printhead (116). A nozzle (124) may include an ejector (242), a firing chamber (244), and an opening (246). The opening (246) may allow fluid, such as ink, to be deposited onto a surface, such as a print medium (FIG. 1, 126). The firing chamber (244) may include a small amount of fluid. The ejector (242) may be a mechanism for ejecting fluid through an opening (246) from a firing chamber (244), where the ejector (242) may include a firing resistor or other thermal device, a piezoelectric element, or other mechanism for ejecting fluid from the firing chamber (244).

For example, the ejector (242) may be a firing resistor. The firing resistor heats up in response to an applied voltage. As the firing resistor heats up, a portion of the fluid in the firing chamber (244) vaporizes to form a bubble. This bubble pushes liquid fluid out the opening (246) and onto the print medium (FIG. 1, 126). As the vaporized fluid bubble pops, a vacuum pressure within the firing chamber (244) draws fluid into the firing chamber (244) from the fluid supply (112), and the process repeats. In this example, the printhead (116) may be a thermal inkjet printhead.

In another example, the ejector (242) may be a piezoelectric device. As a voltage is applied, the piezoelectric device changes shape which generates a pressure pulse in the firing chamber (244) that pushes a fluid out the opening (246) and onto the print medium (FIG. 1, 126). In this example, the printhead (116) may be a piezoelectric inkjet printhead.

The printhead (116) and printer cartridge (114) may also include other components to carry out various functions related to fluidic ejection. For simplicity, in FIGS. 2A and 2B, a number of these components and circuitry included in the printhead (116) and printer cartridge (114) are not indicated; however such components may be present in the printhead (116) and printer cartridge (114). In some examples, the printer cartridge (114) is removable from a printing system for example, as a disposable printer cartridge.

Figure 3:
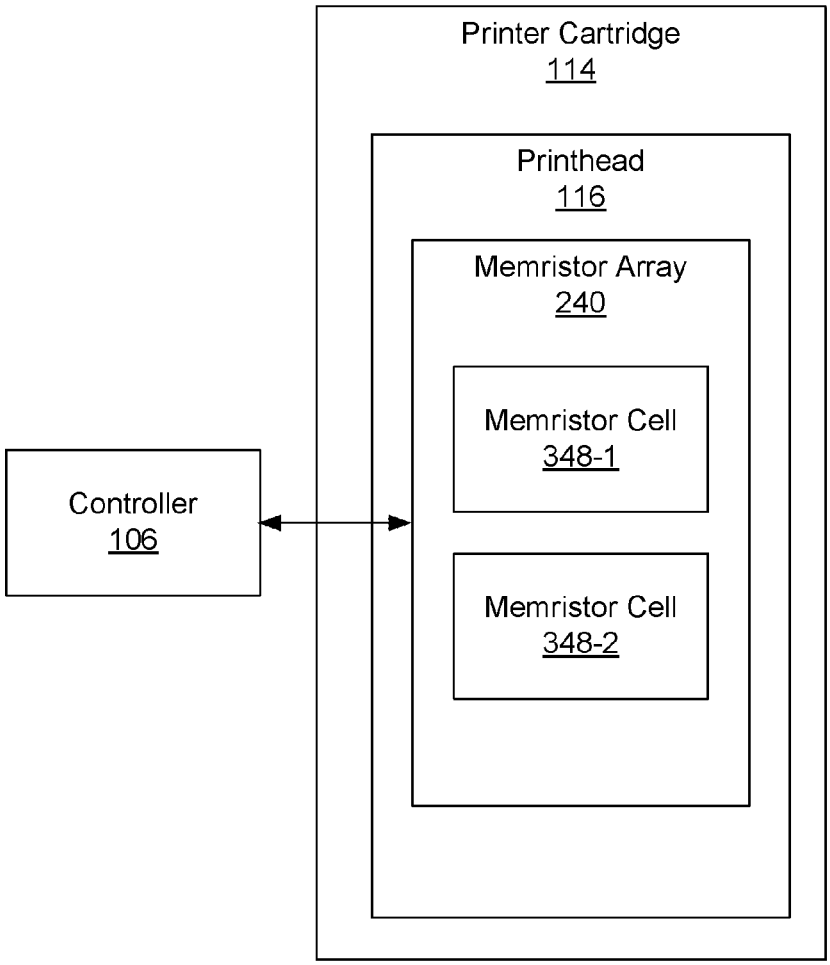
FIG. 3 is a block diagram of a printer cartridge that uses a printhead with a number of memristors and inverters according to one example of the principles described herein.

FIG. 3 is a block diagram of a printer cartridge (114) that uses a printhead (116) with a number of memristors and inverters according to one example of the principles described herein. In some examples, the printer cartridge (114) includes a printhead (116) that carries out at least a part of the functionality of the printer cartridge (114). For example, the printhead (116) may include a number of nozzles (FIG. 1, 124). The printhead (116) ejects drops of fluid from the nozzles (FIG. 1, 124) onto a print medium (FIG. 1, 126) in accordance with a received print job. The printhead (116) may also include other circuitry to carry out various functions related to printing. In some examples, the printhead (116) is part of a larger system such as an integrated printhead (IPH). The printhead (116) may be of varying types. For example, the printhead (116) may be a thermal inkjet (TIJ) printhead or a piezoelectric inkjet (PIJ) printhead, among other types of printhead (116).

The printhead (116) includes a memristor array (240) to store information relating to at least one of the printer cartridge (114) and the printhead (116). In some examples, the memristor array (240) includes a number of memristor cells (348-1, 348-2) formed in the printhead (116). To store information, a memristor within each memristor cell (348) may be set to a particular resistance state. As memristors are non-volatile, this resistance state is retained even when power is removed from the printhead (116). The memristor cell (348) may include an inverter circuit to invert the resistance state of the memristor cell (348). In some examples there may be an inverter circuit for each memristor cell (348), while in other examples there may be an inverter circuit for an entire memristor array (240).

A memristor has a metal-insulator-metal layered structure. More specifically, the memristor may include a bottom electrode (metal), a switching oxide (insulator), and a top electrode (metal).

The number of memristor cells (348) are grouped together into a memristor array (240). In some examples, the memristor array (240) may be a cross bar array. In this example, each memristor may be formed at an intersection of a first set of elements and a second set of elements, the elements forming a grid of intersecting nodes, each node defining a memristor. In this example, each memristor cell (348) may have a corresponding inverter circuit. In another example, an inverter circuit may function for an entire memristor array (240). In yet another example, the memristor array (240) may include a number of memristor cells (348) that form a one-to-one structure with a number of transistors. For example, an integrated circuit may include a number of addressing units. Each addressing unit may include a number of components that allow for multiplexing and logic operations. The memristor cell (348) may be designed to be individually addressed by a distinct addressing unit. In some examples, the addressing units may be transistors. In this example, the memristor cell (348) may share a one transistor-one memristor (1T1M) addressing structure with the addressing units of the integrated circuit.

The memristor array (240) may be used to store any type of data. Examples of data that may be stored in the memristor array (240) include fluid supply specific data and/or fluid identification data, fluid characterization data, fluid usage data, printhead (116) specific data, printhead (116) identification data, warranty data, printhead (116) characterization data, printhead (116) usage data, authentication data, security data, Anti-Counterfeiting data (ACF), fluid drop weight, firing frequency, initial printing position, acceleration information, and gyro information, among other forms of data. In a number of examples, the memristor array (240) is written at the time of manufacturing and/or during the operation of the printer cartridge (114).

In some examples, the printer cartridge (114) may be coupled to a controller (106). The controller (106) receives a control signal from an external computing device (FIG. 1, 102). The controller (106) may be an Application-Specific Integrated Circuit (ASIC), for example, a printer ASIC. A computing device (FIG. 1, 102) may send a job to the printer cartridge (114), the job being made up of text, images, or combinations thereof to be deposited onto a print medium (FIG. 1, 126). The controller (106) may facilitate storing information to the memristor array (240). Specifically, the controller (106) may pass at least one control signal to the number of memristor cells (348). The inverter circuit described herein ensures backwards compatibility of memristor arrays (240) with other ASIC systems. For example, the controller (106) may be coupled to the printhead (116), via a control line such as an identification line. Via the identification line, the controller (106) may change the resistance state of a number of memristors in the memristor array (240) to effectively store information to a memristor array (240). For example, the controller (106) may send data such as authentication data, security data, and job data, in addition to other types of data to the printhead (116) to be stored on the memristor array (240).

While specific reference is made to an identification line, the controller (106) may share a number of lines of communication with the printhead (116), such as data lines, clock lines, and fire lines. For simplicity, in FIG. 3 the different communication lines are indicated by a single arrow.

Figure 4:
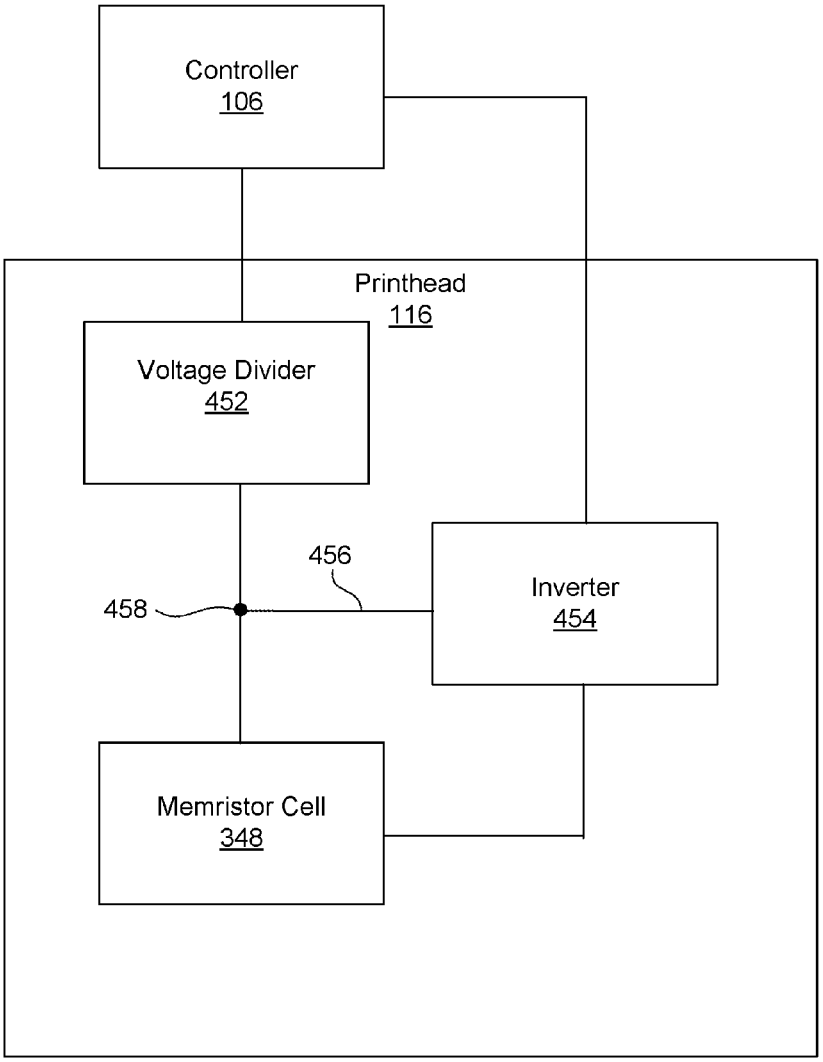
FIG. 4 is a block diagram of a printhead with a number of memristors and inverters according to one example of the principles described herein.

FIG. 4 is a block diagram of a printhead (116) with a number of memristors and inverters (454) according to one example of the principles described herein. The figure also depicts a voltage divider (452) connected in series with the memristor cell (348). While FIG. 4 depicts a single memristor cell (348) connected in parallel to the inverter (454), a number of memristor cells (348) such as memristor cells (348) in a memristor array (FIG. 2, 240) may be coupled to the inverter (454). As described above, a memristor selectively stores data based on a resistance state. In the virgin state, a high resistance may indicate a "0", while a low resistance state may indicate a "1." A group of memristors, for example in an array (FIG. 2, 240) form a string of ones and zeroes that will store the aforementioned data. The logical values mentioned above may be chosen arbitrarily in some examples. In other examples, certain resistance states correspond with certain logical values.

Due to its material properties, a memristor in a memristor cell (348) in its virgin state is in a high resistance state, and after programming, the memristor may be put into a low resistance state. In some examples, a system recognizes a virgin memory device as one in a low resistance state. In this case the inverter (454) inverts the resistance state of the memristor such that the opposite resistance state is read by the controller (106) in order for the hardware utilizing memristor cells (348) to be backwards compatible with other printheads (116) and controllers (106).

A memristor cell (348) includes a memristor and a demultiplexing device which is used to select a specific memristor so that the controller (106) may perform an operation on the memristor. An example of such an operation includes a read operation, or an operation which determines whether the memristor is in a high resistance state or a low resistance state to determine if the corresponding stored value is a logical one or a logical zero. Another example of an operation to be performed by the controller (106) on a memristor includes a write operation, in which the resistance state of the memristor is set to either a high resistance state or a low resistance state in order to save data in the memristor cell (348).

As described above, information is read from a memristor by passing current through the memristor, measuring the voltage across the memristor, and calculating the resistance of the memristor using Ohm's Law ($V=I\times R$). A controller (106) is used to perform this read operation. The controller (106) reads the resistance of the printhead (116) circuit as a whole as opposed to the individual resistance of the memristor cell (348). In this way, the inverter (454) may change what is seen by the controller (106) and invert the resistance state of the memristor cell (348) as seen by the controller (106).

As described above, the inverter (454) may include a transistor and a resistor. The transistor of the inverter (454) may be turned on and off by a control signal (456) which branches between the voltage divider (452) and the memristor cell (348) from a node (458). The voltage at the node (458) may function as a control voltage for the transistor of the inverter (454), turning the transistor on and off. Based on the voltage divider equation, when the resistance state of the memristor cell (348) is high, the voltage at the node (458) will be high, and will turn on the transistor of the inverter (454). This creates a parallel circuit with two branches. The branch with the inverter (454) has a low value resistance, while the branch of the voltage divider (452) and the memristor cell (348) have a high value resistance. The total resistance of the two branches as seen by the controller (106) will be less than the resistance of the smallest branch, meaning the overall resistance will be low. In this example, the controller (106) reads a low resistance value, while the memristor cell (348) is set to a high resistance value. Additionally, the resistance value of the printhead (116) circuit as read by the controller (106) may be manipulated by changing the value of the small resistor in the inverter (454).

In the example above, if the resistance value of the memristor cell (348) is set to a low resistance state, then the voltage at the node (458) will be low. If this voltage is below the threshold of the transistor in the inverter (454), the transistor will be in an off state, and will function as an open circuit. This will cause the effective resistance of the printhead (116) to be equal to the resistance of the voltage divider (452) in series with the resistance of the memristor cell (348). Resistance values are added together when in series, so the resistance of the printhead (116) as read by the controller (106) will be high. In this example, the controller (106) reads a high resistance state while the resistance state of the memristor cell (348) is set to a low resistance state.

As described above, the inverter (454) may be beneficial in that it causes the controller (106) of a printhead (116) circuit to read a resistance level of a printhead (116) circuit as high when the memristor is set to a low resistance level, and vice versa. This is beneficial when designing memristor devices for backwards compatibility. Some previous devices may assign certain resistance states to specific logical values, which may be contrary to that which is provided by a memristor, and therefore the resistance state of the memristor is inverted in order to maintain compatibility with existing devices.

Figure 5:
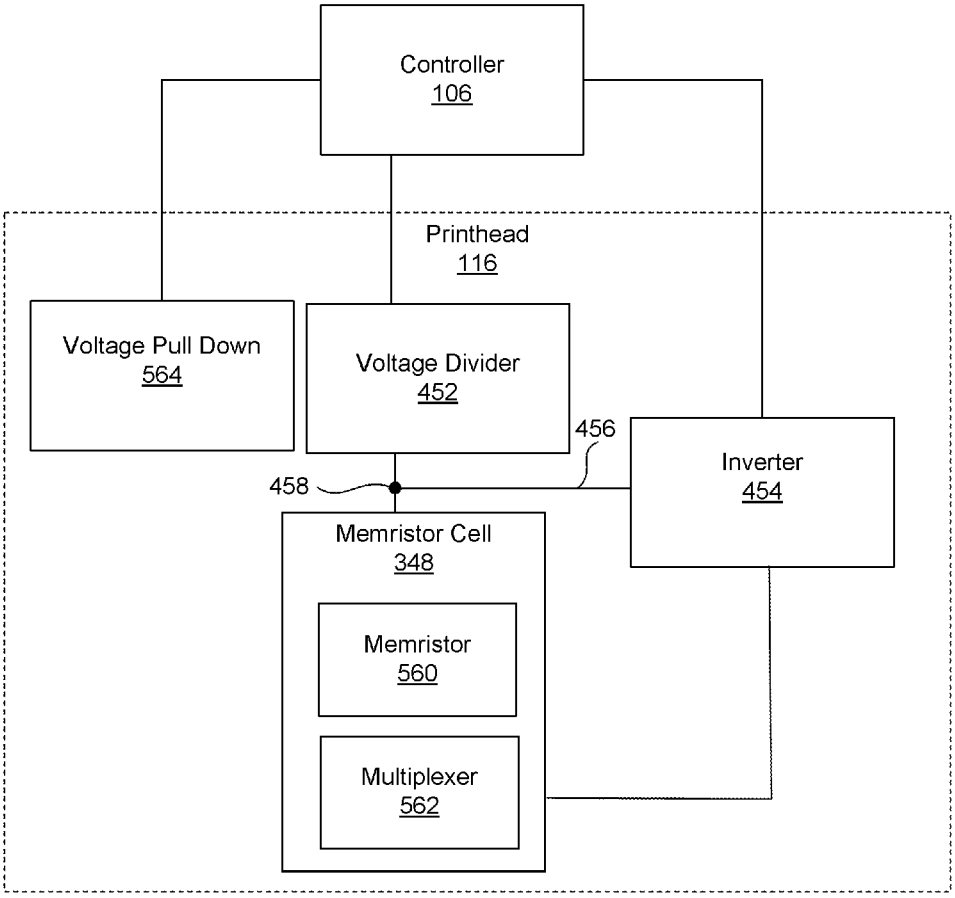
FIG. 5 is a block diagram of a printhead with a number of memristors and inverters according to another example of the principles described herein.

FIG. 5 is a block diagram of a printhead (116) with a number of memristors (560) and inverters (454) according to one example of the principles described herein. In addition to the components depicted in FIG. 4, FIG. 5 also depicts the printhead (116) circuit with a voltage pull down (564). Further, the memristor cell (348) includes a memristor (560) and a de-multiplexer (562).

The memristor cell (348) includes at least one memristor (560) to store a resistance state. As described above, a memristor (560) selectively stores data based on a resistance state of the memristor (560). In addition, the memristor cell (348) may also include a de-multiplexer (562) that receives a control signal and selects a particular memristor (560) to be read from, or to be written to. For example, as will be described in further detail below, the de-multiplexer (562) may include a number of transistors that select a memristor (560) in an array (FIG. 2, 240) such as a cross bar array. In other words, the de-multiplexer (562) selects a memristor (560) to activate, an active memristor (560) being a memristor (560) that is to be written to or read from. Once active, the memristor (560) may be read from or written to.

The printhead (116) circuit may also include a voltage pull down (564), which may include a resistor placed in parallel with the voltage divider (452) and in parallel with the inverter (454). The voltage pull down (564) may control the current flowing through the memristor (560) during a read operation. This helps to prevent an applied voltage from the controller (106), meant to read the value in the memristor (560), from inadvertently writing to the memristor (560). More specifically, the voltage pull down (564) keeps the voltage applied by the controller (106) to perform a read operation from exceeding the switching voltage of the memristor (560) and changing the resistance state of the memristor (560). This would cause an unintentional write to the memristor (560) and could potentially corrupt the data stored in a memristor (560) or in an array (FIG. 2, 240) of memristors. The voltage pull down (564) in some examples may be a resistor having a resistance of between 10,000 Ohms (Ω) to 100,000Ω. However, the specific resistances indicated are examples and other value resistors may be used.

Figure 6:
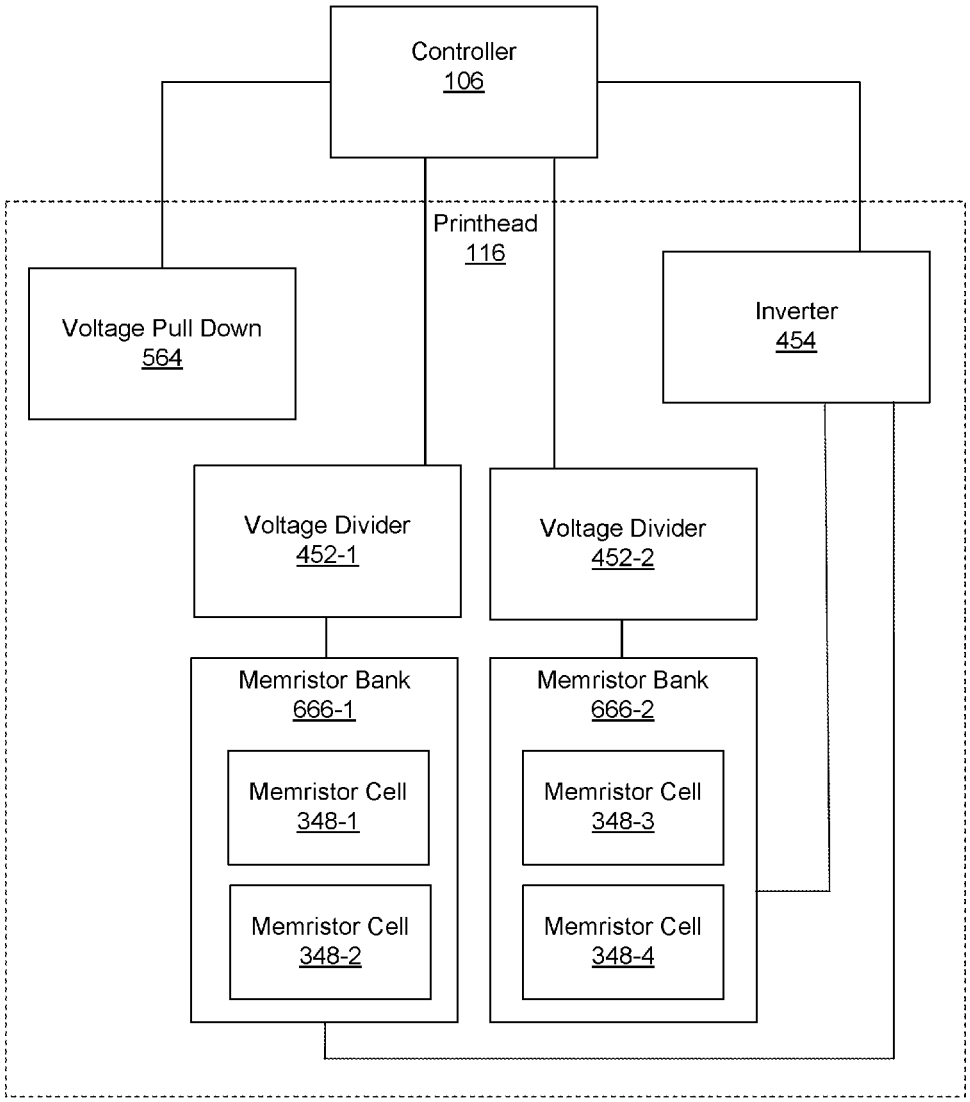
FIG. 6 is a block diagram of a printhead with a number of memristors and inverters according to yet another example of the principles described herein.

FIG. 6 is a block diagram of a printhead (116) with a number of memristors (FIG. 5, 560) and inverters (454) according to one example of the principles described herein. In some examples, the memristor array (FIG. 2, 240) may be divided into a number of memristor banks (666). For example, a memristor array (FIG. 2, 240) may include a first memristor bank (666-1) and a second memristor bank (666-2). A memristor bank (666) may include a number of memristor cells (348-1, 348-2, 348-3, 348-4), which may form a memristor array (FIG. 2, 240) in some cases, as described above. As depicted in FIG. 6, a number of memristor banks (666) may be connected in parallel, each connected in series with a voltage divider (452-1, 452-2). The number of memristor banks (666) may be connected in parallel with an inverter (454). A voltage pull down (564) is also connected in parallel with the number of memristor banks (666) and voltage dividers (452).

As indicated in FIG. 6, a single inverter (454) may be connected in parallel with multiple memristor cells (348) and invert the resistance state of the multiple memristor cells (348). Accordingly, any number of memristor banks (666) or memristor cells (348) may be connected in parallel to an inverter (454). While FIG. 6 depicts a single inverter (454) for multiple memristor banks (666), in some examples, each memristor cell (348) may be connected to an individual inverter (454). In another example, each memristor bank (666) may be connected to an individual inverter (454).

Connecting multiple memristor banks (666) or memristor cells (348) to a single inverter (454) may be beneficial by reducing the space which an inverter (454) would take up on a printhead (116) circuit. As described above, silicon space on a printhead (116) is valuable. By using a small number of inverters (454) on a printhead (116), as compared to the large number of memristor cells (348) which will be contained on a printhead (116), significant circuit space can be conserved. This may increase the amount of data which can be stored on a printhead (116), while preserving backwards compatibility.

As described above, each memristor cell (348) may include a de-multiplexer (FIG. 5, 562) which is used to select a specifically addressed memristor (FIG. 5, 560). In one example, the memristor cells (348-1, 348-2) of a single memristor bank (666-1), may share a column selection de-multiplexing transistor, and use a row selection de-multiplexing transistor to select an individually addressed memristor cell (348-1). In another example, the memristor cells (348-1, 348-2) of a single memristor bank (666-1), may share a row selection de-multiplexing transistor, and use a column selection de-multiplexing transistor to select an individually addressed memristor cell (348-1). In this way, space on the printhead (116) circuit can be further preserved through the sharing of de-multiplexing transistors across multiple memristor cells (348).

Figure 7A:
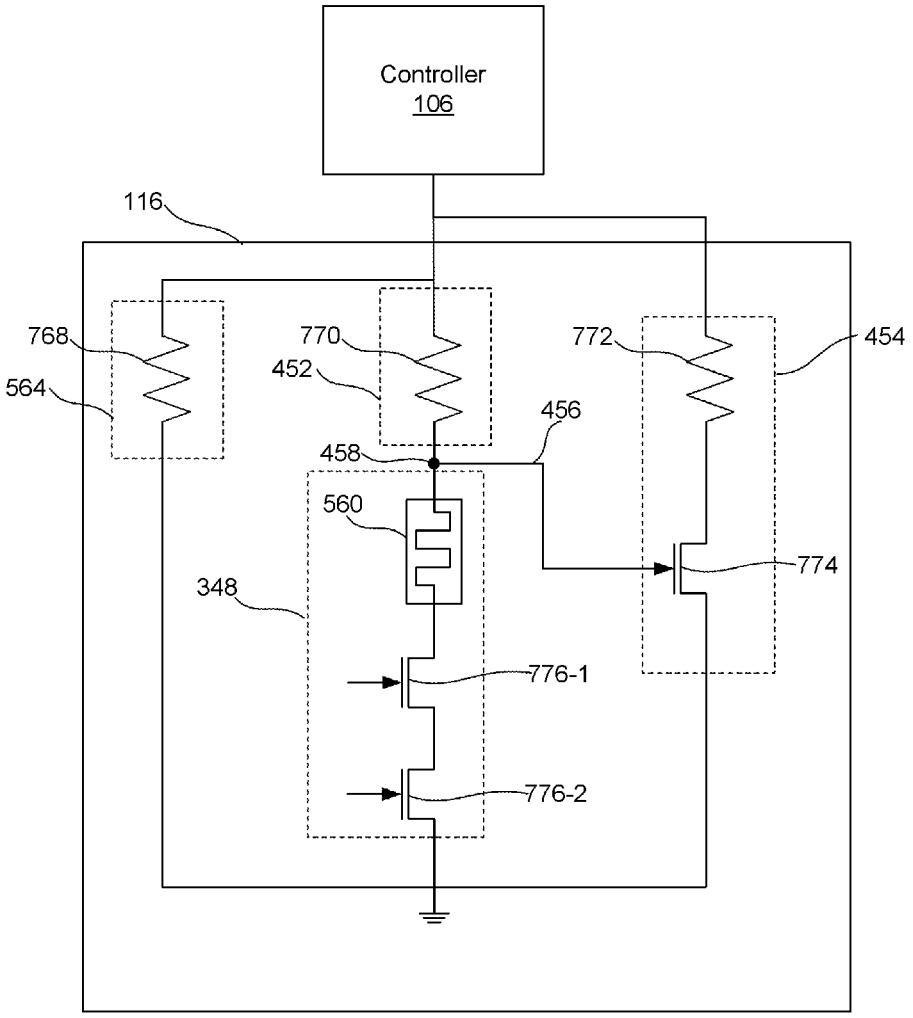
FIGS. 7A-7C are circuit diagrams of a number of memristors and inverter circuits according to one example of the principles described herein.
Figure 7B:
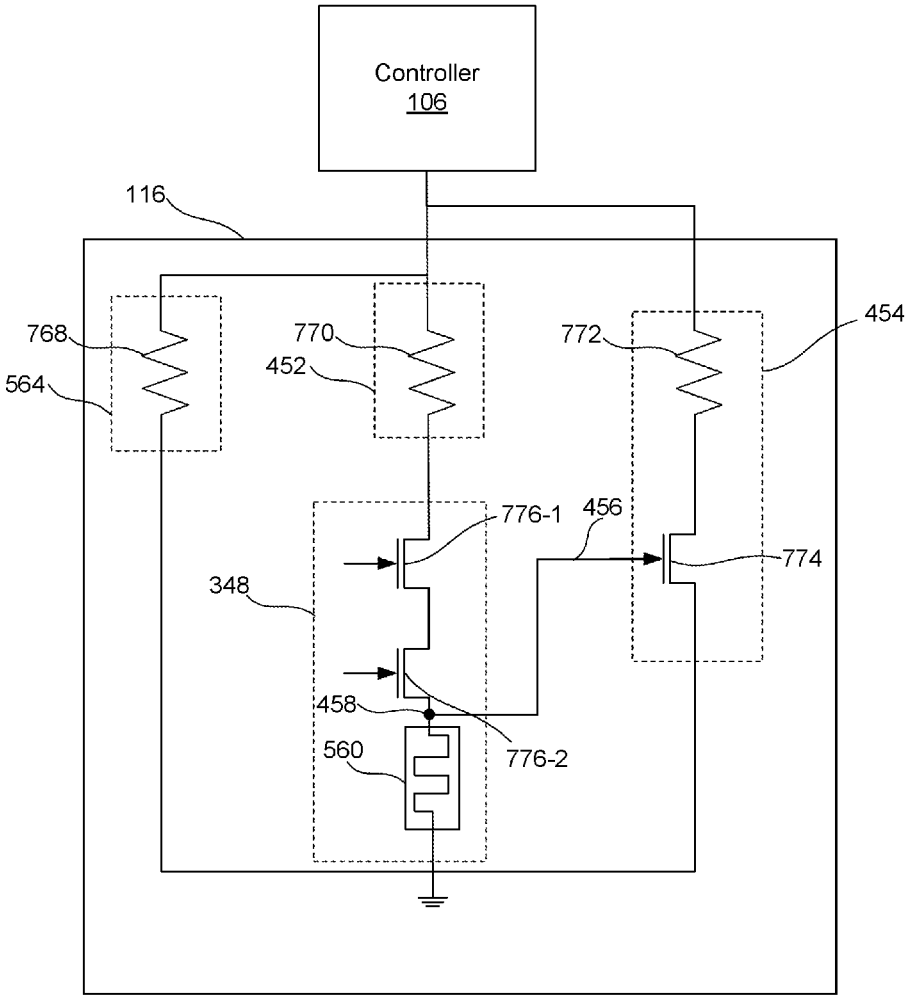
Figure 7C:
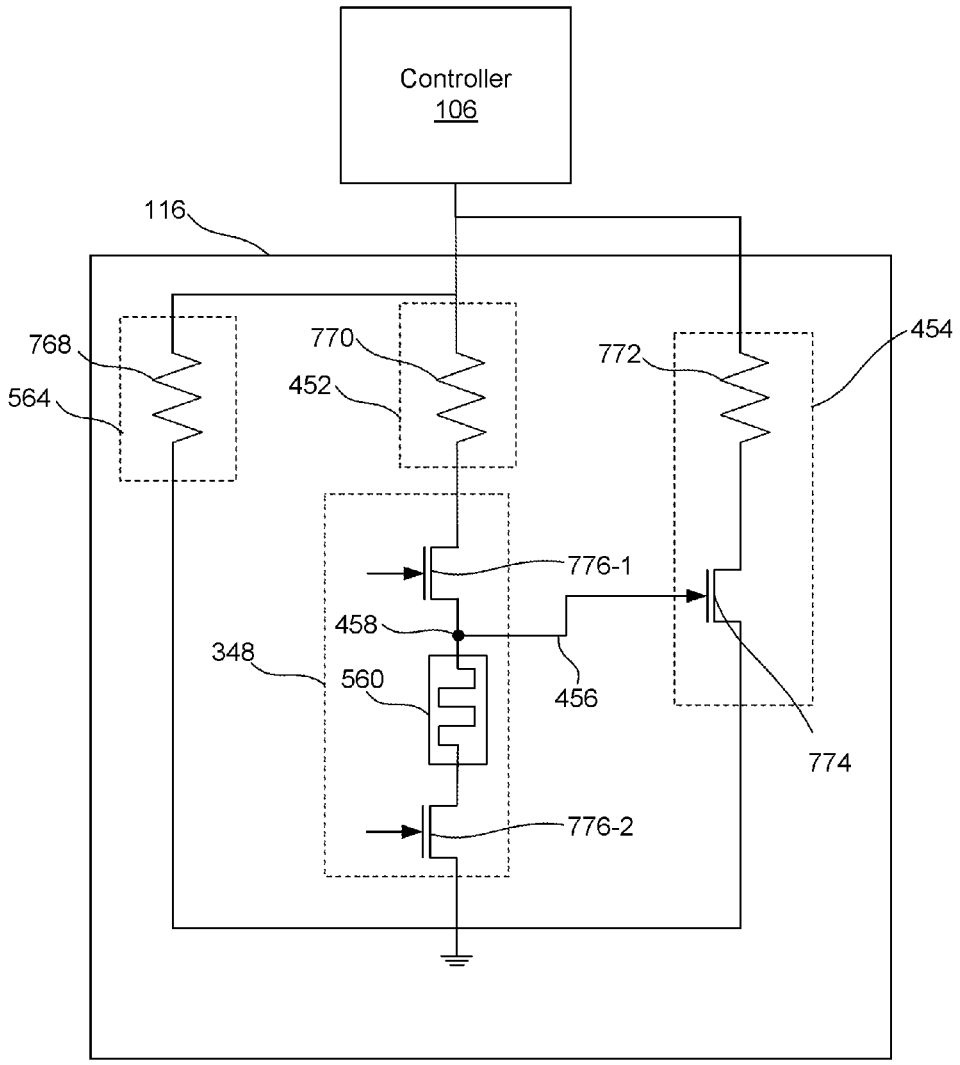

FIG. 7A, 7B, and 7C are circuit diagrams which depict a printhead (116) with a number of memristors (560) and inverter (454) circuits according to one example of the principles described herein. Each of the FIGS., 7A, 7B, and 7C, show a different configuration of the memristor cell (348). More specifically, the arrangement of the memristor (560), first selecting transistor (776-1), and second selecting transistor (776-2) which in each figure are connected serially, but in different orders. Together, the first selecting transistor (776-1) and second selecting transistor (776-2) may form the de-multiplexer (FIG. 5, 562) described above.

FIG. 7A shows a memristor cell (348) in a low side switch (LSS) orientation. In this orientation, the memristor (560) is closest to the node (458), with the first selecting transistor (776-1) and second selecting transistor following (776-2). FIG. 7B shows a memristor cell (348) in a high side switch orientation, with the first selecting transistor (776-1) and second selecting transistor (776-2) on the voltage divider (452) side of the node (458) and the memristor (560) on the bottom of the node (458). FIG. 7C depicts a memristor cell (348) in a mixed high side low side switch orientation, with the first selecting transistor (776-1) on the voltage divider (452) side of the node (458), while the memristor (560) and second selecting transistor (776-2) are on the other side.

In a specific example, in FIG. 7A, the memristor (560) may be in a high resistance state, which may be a resistance of 5,000Ω. In this example, the voltage divider (452) may include a voltage divider resistor (770) with a resistance of 10,000Ω, the voltage pull down (564) may include a pull down resistor (768) with a resistance of 50,000Ω. Additionally, the inverter (454) may include an inverter resistor (772) with a resistance of 1,000 Ω and an inverter transistor (774) with a threshold voltage of 1.5 V. The voltage at the node (458) may be calculated using the following equation:

$$V_{out}=I_{in(memristor)}\times R_2 \quad \text{(Equation 1).}$$

In Equation 1, $V_{out}$ refers to the voltage at the node (458), $I_{in(memristor)}$ refers to a portion of an input current that passes through the memristor cell (348). $I_{in(memristor)}$ is part of input current, $I_{in}$, which $I_{in}$ is input to the printhead (116) memory system by the controller (106). In this example, $I_{in}$ has a value of 1.2 milliAmps (mA). $R_2$ refers to the resistance value of the memristor cell (348). In this example, during a read operation, the controller (106) passes a current, $I_{in}$, to the printhead (116) circuit. Initially, the inverter transistor (774) is turned off and the current, $I_{in}$, is distributed between the voltage pull down (564) path and memristor cell (348) path. When the memristor (560) is in a high resistance state, the voltage at the node (458), caused by a ramp up current across the memristor cell (348), is large enough to reach the threshold voltage of the inverter transistor (774), which threshold voltage in this example is 1.5 V. Accordingly, the inverter (454) circuit is turned on and part of the current, $I_{in}$, is channeled through the inverter (454).

In this example, the voltage between the gate and the source of the inverter transistor (774) modulates the current passing through this branch. This turns the inverter (454) path into a current source with current modulated by the voltage on the node (458), and prevents the current from increasing through the memristor cell (348) path. When the current distribution among the voltage pull down (564) path, the memristor cell (348) path and the inverter (454) path reaches equilibrium, in this example around 1.7 V, as measured at the node (458), the controller (106) reads the resistance state of the entire system when obtaining data from the circuit. The total resistance of the circuit may be calculated using the following equation:

$$R_{tot}=I_{in(memristor)}\times(R_1+R_2)/I_{in} \quad \text{(Equation 2).}$$

In Equation 2, $R_{tot}$ refers to the total resistance of the circuit, $R_1$ refers to the value of the resistance of the voltage divider resistor (770), $R_2$ refers to the value of resistance of the memristor cell (348), $I_{in(memristor)}$ refers to the current through the memristor cell (348), and $I_{in}$ refers to the current input to the printhead (116). All values used in this example are provided above, and according to Equation 2, the total resistance of the circuit $R_{tot}$ when the memristor is in a high resistance state is approximately 4,250Ω.

By comparison, when the memristor (560) is in a low resistance state, for example having a resistance of 1,000Ω, the voltage at the node (458) is around 0.21 V which is less than the threshold voltage of the inverter transistor (774). Accordingly, the inverter (454) path is turned off. At this stage, the total current, $I_{in}$, of 1.2 mA is distributed between the voltage pull down (564) path and the memristor cell (348) path. In this case, the total resistance is governed by Equation 3.

$$R_{tot} = 1\Big/\left(\frac{1}{R_1+R_2}+\frac{1}{R_3}\right). \quad \text{(Equation 3)}$$

In Equation 3, $R_3$ refers to the resistance of the voltage pull down (564) and $R_{tot}$ is calculated as 9,000Ω. In this example, the resistance state of the memristor is inverted as seen from the controller (106).

The overall resistance of the printhead (116) circuit when the memristor (560) is in a low resistance state may similarly be calculated using Equations 1 and 3. In a low resistance state, the memristor (560) may have a resistance of approximately 1,000Ω. Using Equation 1, the voltage at the node (458) can be calculated to be approximately 0.21 V. This value being less than the threshold voltage of the inverter transistor (774) of 1.5 V, turns the transistor off. In other words, with the memristor (560) in a low resistance state, Equation 1 indicates a value for the voltage at the node (458) below the threshold voltage of the inverter transistor (774). The inverter transistor (774) then acts as an open circuit. The equivalent circuit is that of two resistors in parallel. While specific resistance values have been used in these examples, any value resistance may be used and the specific values indicated are merely used as examples.

A printer cartridge (FIG. 1, 114) and printhead (FIG. 1, 116) with a number of memristors (FIG. 5, 560) and inverters (FIG. 4, 454) may have a number of advantages, including: (1) inverting the resistance state of the memristor cell (FIG. 3, 348) as read by the controller (FIG. 1, 106); (2) providing backwards compatibility for memristor (FIG. 5, 560) based memory on printhead (FIG. 1, 116) technology; (3) improving printhead (FIG. 1, 116) memory performance; and (4) increasing the amount of information that can be stored on a given area of a printhead (FIG. 1, 116) circuit by using a single inverter (FIG. 4, 454) for a number of memristor cells (FIG. 3, 348).

Aspects of the present system are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (FIG. 1, 108) of the system (FIG. 1, 1004) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printhead with a number of memristors and inverters, the printhead comprising:

a number of nozzles to deposit an amount of fluid onto a print medium, each nozzle comprising:

a firing chamber to hold the amount of fluid;

an opening to dispense the amount of fluid onto the print medium; and an ejector to eject the amount of fluid through the opening;

a memristor cell comprising a memristor to store data;

a voltage divider serially connected to the memristor cell; and an inverter connected in parallel with the memristor cell and the voltage divider.

2. The printhead of claim 1, in which the fluid is inkjet ink.

3. The printhead of claim 1, in which the inverter is a transistor serially connected to a resistor.

4. The printhead of claim 3, in which:

the transistor is in an on state when the memristor is in a first resistance state; and the transistor is in an off state when the memristor is in a second resistance state, in which the second resistance state is opposite the first resistance state.

5. The printhead of claim 3, in which an output of the voltage divider is a control input into the transistor.

6. The printhead of claim 1, in which the voltage divider is a resistor serially connected to the memristor.

7. The printhead of claim 1, further comprising a voltage pull down to reduce the voltage across the printhead.

8. The printhead of claim 1, in which the memristor cell further comprises a de-multiplexer to selectively activate the memristor.

9. A printer cartridge with a number of memristors and inverters, the printer cartridge comprising:

a fluid supply; and a printhead to deposit fluid from the fluid supply onto a print medium, the printhead comprising:

a number of memristor cells, each memristor cell including a memristor to store data;

a number of voltage dividers serially connected to the number of memristor cells; and at least one inverter connected in parallel with the number of memristor cells.

10. The cartridge of claim 9, in which:

the fluid is inkjet ink;

the printer cartridge is an inkjet printer cartridge; and the printhead is an inkjet printhead.

11. The cartridge of claim 9, in which the at least one inverter comprises a transistor and a resistor.

12. The cartridge of claim 9, in which:

an output voltage of a voltage divider is greater than a threshold voltage of the at least one inverter when a corresponding memristor cell is in a first resistance state; and an output voltage of the voltage divider is less than a threshold voltage of the at least one inverter when a corresponding memristor cell is in a second resistance state.

13. The cartridge of claim 9, in which a number of memristor cells share an inverter.

14. The cartridge of claim 9, in which a number of memristor banks of memristor cells share a single inverter.

15. The cartridge of claim 9, further comprising a voltage pull down connected in parallel to the at least one inverter and the number of memristor cells.

* * * * *